US011167972B2

(12) United States Patent
Aiello

(10) Patent No.: US 11,167,972 B2
(45) Date of Patent: Nov. 9, 2021

(54) PLASTIC LIQUID CONTAINER AND DISPENSING SYSTEM

(71) Applicant: Daniel W. Aiello, Smithtown, NY (US)

(72) Inventor: Daniel W. Aiello, Smithtown, NY (US)

( * ) Notice: Subject to any disclaimer, the term of this patent is extended or adjusted under 35 U.S.C. 154(b) by 347 days.

(21) Appl. No.: 16/278,236

(22) Filed: Feb. 18, 2019

(65) Prior Publication Data

US 2019/0225475 A1 Jul. 25, 2019

Related U.S. Application Data

(63) Continuation-in-part of application No. 15/938,132, filed on Mar. 28, 2018, now Pat. No. 10,791,988.

(60) Provisional application No. 62/488,087, filed on Apr. 21, 2017, provisional application No. 62/534,437, filed on Jul. 19, 2017.

(51) Int. Cl.

| | |
|---|---|
| ***B67D 1/00*** | (2006.01) |
| ***B67D 1/08*** | (2006.01) |
| ***B65D 8/00*** | (2006.01) |
| ***B65D 83/00*** | (2006.01) |
| ***B67D 3/00*** | (2006.01) |
| ***B65D 77/06*** | (2006.01) |

(52) U.S. Cl.

CPC ..... *B67D 1/0004* (2013.01); *B65D 11/04* (2013.01); *B65D 77/06* (2013.01); *B65D 83/0055* (2013.01); *B67D 1/0805* (2013.01); *B67D 1/0807* (2013.01); *B67D 3/0051* (2013.01); *B67D 3/007* (2013.01); *B67D 2001/0814* (2013.01)

(58) Field of Classification Search

CPC .. B67D 1/0004; B67D 1/0805; B67D 1/0807; B67D 3/0051; B67D 3/007; B67D 2001/0814; B65D 11/04; B65D 77/06; B65D 77/065; B65D 77/067; B65D 83/0055

USPC ..... 222/105, 107, 325–327, 80–91

See application file for complete search history.

(56) References Cited

U.S. PATENT DOCUMENTS

| | | | | |
|---|---|---|---|---|
| 3,977,569 A * | 8/1976 | Scholle | B65D 11/06 | 222/105 |
| 4,330,066 A * | 5/1982 | Berliner | B65D 77/06 | 215/12.1 |
| 4,921,135 A * | 5/1990 | Pleet | B67B 7/26 | 222/105 |
| 5,680,959 A * | 10/1997 | Ettore | B65D 77/067 | 222/1 |
| 7,051,901 B2 * | 5/2006 | Hickert | B65D 81/245 | 222/1 |
| 8,967,430 B2 * | 3/2015 | Wrigley | B67D 3/045 | 222/83 |

(Continued)

*Primary Examiner* — J C Jacyna

(74) *Attorney, Agent, or Firm* — John F. Vodopia

(57) ABSTRACT

A plastic liquid container and dispensing system includes a plastic bottle with first and second detachable bottle parts, a bladder for holding liquid including a bladder top, a bladder base and a bladder lock-nut positioned in the bladder inner volume and a spout having a spout body with a connecting end, an internal liquid flow path extending from the connecting end to a liquid outflow port and a release button for enabling liquid flow through the internal liquid flow path and out the liquid outflow port. The bladder opening is covered by a covering that is pierced by a blade at the spout connecting end to create a liquid flow path from the bladder to and through the spout (when the release button is pressed).

20 Claims, 13 Drawing Sheets

(56) References Cited

U.S. PATENT DOCUMENTS

| | | | | |
|---|---|---|---|---|
| 9,290,295 | B2 * | 3/2016 | Poggio | B65D 81/24 |
| 2007/0284389 | A1 * | 12/2007 | Jacobs | B67D 3/0067 222/1 |
| 2009/0250489 | A1 * | 10/2009 | Saunders | B65D 77/06 222/105 |
| 2012/0312837 | A1 * | 12/2012 | Zavarella | B67D 1/0418 222/95 |
| 2017/0015480 | A1 * | 1/2017 | Slack | B65D 23/02 |
| 2017/0158485 | A1 * | 6/2017 | Lansberry | B67D 3/0067 |

* cited by examiner

PLASTIC LIQUID CONTAINER AND DISPENSING SYSTEM

CROSS-REFERENCE TO RELATED APPLICATIONS

This application is a continuation-in-part (CIP) application that claims priority under 35 USC § 120 from U.S. application Ser. No. 15/938,142, filed Mar. 28, 2018 and issued Nov. 19, 2019, as U.S. Pat. No. 10,479,671 ("the parent application"); the parent application claims priority under 35 USC § 119(e) from U.S. Provisional Patent Application No. 62/488,087, filed Apr. 21, 2017, and from U.S. Provisional Patent Application No. 62/534,437, filed Jul. 19, 2017. The contents of the parent application and the two provisional applications are incorporated herein by reference.

BACKGROUND OF THE INVENTION

The invention relates generally to a plastic bottle, and more particularly, the invention is directed to a plastic liquid container and dispensing system, formed with plastic parts that are BPA-free, non-toxic and made from material with less/no leaching potential.

Bags and bladders keep liquids, particularly red wines, fresher, longer, but are they safe?No, not for many of the bags and bladders currently on the market! These bags are oftentimes made with toxic plastic, like BPAs, that can transfer from the plastic bag to the liquid such as wine that a user has stored in the bag for storage and use. Not only can leaching result in a chemical taste and unappealing film, but consuming the liquid stored in such a bag is ill-advised, and probably unsafe.

Unfortunately, boxed wine looks cheap, and is not durable enough; plus, it doesn't make a presentable gift, and wine drinkers and manufacturers haven't chosen boxed wine as the preferred vehicle for their wine.

Glass is no better, because glass breaks. Accordingly, glass liquid storage bottles do not travel well, and are not permitted in many places a user may wish to take them, such as a park. When it comes to wine, a user needs a wine opener most times, which tend to be left behind; the cork material can get into your wine, and the screw tops seem to get lost. After-market plastic corks and tops are toxic and don't work well. Moreover, tragically, once a typical bottle of wine is opened, it goes bad quickly and results in wasted wine. The numerous and often confusing devices and contraptions on the market today that allege to keep the air out/from opened red wines, many of which do not work effectively or cost a small fortune to own.

SUMMARY OF THE INVENTION

The present invention provides a plastic liquid container and dispensing system that overcomes the shortcomings of the prior art.

In a preferred embodiment, the plastic liquid container and dispensing system comprises a non-toxic bladder (that may be bottle-shaped to confirm to the outer plastic bottle) for containing a liquid such as wine, inserted and present within an outer, non-toxic plastic (wine-shaped) bottle.

The plastic liquid container and dispensing system also includes a plastic bottle constructed with a solid base and inner volume of the bottle within which the bladder is placed; approximately three-quarters from the base of the plastic bottle is a portion of bottle that is connected by threads, that when removed, will connect to the bladder spout through inner threads at the top portion of the bottle; the spout is made of non-toxic plastic, and dish-washable safe.

The bladder, at its top, contains, around a circular opening through the inner and outer bladder walls, within which a round, plastic locknut and gasket or washer is affixed to the inner bladder and is integral with the bladder at the bladder opening; the gasket or washer includes an opening at its center for fluid flow. In a most preferred embodiment, the bladder, in its entirety, is disposable and recyclable.

Next, a spout with a connecting portion having outer threads to compliment the inner threads of the bladder locknut (and for an outer cap), and a central fluid flow path, is detachably connected to this plastic locknut and therefore the bladder. Preferably, a plastic gasket or washer is disposed between the spout and the locknut to assure leak-proof sealing. The spout includes activation means, by, for example, a button that when pressed, enables liquids to flow from within the bladder through the opening in the locknut, along a liquid path through the body of the spout and out a port of the spout.

Preferably, all the parts of the plastic liquid container and dispensing system are BPA-free and non-toxic. Preferably, the plastic bottle and spout are reusable, and dishwasher safe for easy cleaning.

In the alternative, the plastic bottle contains a bottle base cap that is swivellable about a hinge (or other means for removing the base such as by threads) to provide a closeable opening for accessing an inner volume of the bottle within which the bladder is positioned and affixed to the bottle (without its top section of the plastic bottle, being removed as with the first embodiment) by the threads on the spout and inner opening at the top of the bottle. The bladder, at its base contains a fill opening for a user to fill the bladder with its liquid product, such as wine.

More specifically, the bladder, at its base (or at its top in an alternative embodiment [see below]), includes a circular opening through which liquid may be input to the bladder (such as wine), or removed from the bladder at the time of consumption. A spout is arranged with a connecting end that passes through the circular opening to connect to a threaded bladder locknut inside the bladder. In one form, the threaded bladder locknut is adhered to the portion of the bladder proximate the circular opening, to render it easier to connect the spout thereto, after the bladder is filled. Preferably, the connecting end includes a gasket on the outside so that when connected to the threaded bladder locknut, the spout seals the circular opening (in a leak-proof manner) unless opened to allow liquid flow into or out of the bladder through the bottle base (or at its top in an alternative embodiment [see below]). The spout includes activation means, for example, a button that when pressed by a user, enables liquids to flow from within the bladder through the opening in the locknut, along a liquid path through the body of the spout and out a port of the spout. Preferably, all the parts of the plastic liquid container and dispensing system are BPA-free and non-toxic.

In one form, the plastic bottle and spout are reusable and dishwasher safe for easy cleaning. Replaceable bladders must have the threaded bladder locknut to attach a spout. In a preferred embodiment, the bladder, in its entirety, is disposable and recyclable, and may come prefilled with a spout for accessing the liquid therein, at either the base or the top (see below).

In an alternative embodiment, the bladder will have the gasket, locknut and circular opening for the spout is at its top, rather than its bottom. As such, a bottle top cap includes an opening through which the spout connecting end must first pass before it can be threaded to the locknut inside the bladder volume to create the seal. Once the spout is connected, the bladder may be filled with liquid that passes through the bottle opening and the spout port in its open state, thereby filling the bladder (or alternatively, allowing liquid present therein to pass out of the bladder). Preferably, a bottle cap included that encloses the spout at the top when no access is desired. While the bottle cap may be form fit, and an alternative form, additional male threads on an outer surface of the spout will enable connection to female threads present on an inner surface of the bottle cap for that surface.

In another embodiment, the inventive plastic liquid container and dispensing system comprises a plastic bottle with first and second detachable bottle parts, a bladder for holding liquid including a bladder top, a bladder base and a bladder lock-nut integrally positioned at or fixedly attached to the bladder base and formed with a flow path for liquid out of the bladder and a spout having a spout body with a connecting end, an internal liquid flow path extending from the connecting end to a liquid outflow port and a release button for enabling liquid flow through the internal liquid flow path and out the liquid outflow port. The spout is removably attached via first threads to the bladder lock-nut to connect the spout to the bladder and a bladder flange positioned between the spout and the bladder gasket facilitates connecting the bladder and spout to the bottle top. Detaching the first bottle part from the second bottle part enables access to the bottle internal volume, into which the bladder is removably inserted into the bottle inner volume and actuating the release button opens a liquid flow for the liquid present in the bladder to flow through the spout at the top of the bottle.

DRAWING FIGURES

Further features and advantages of the invention will become apparent from the description of embodiments that follows, with reference to the attached figures, in which.

Figure 3A:
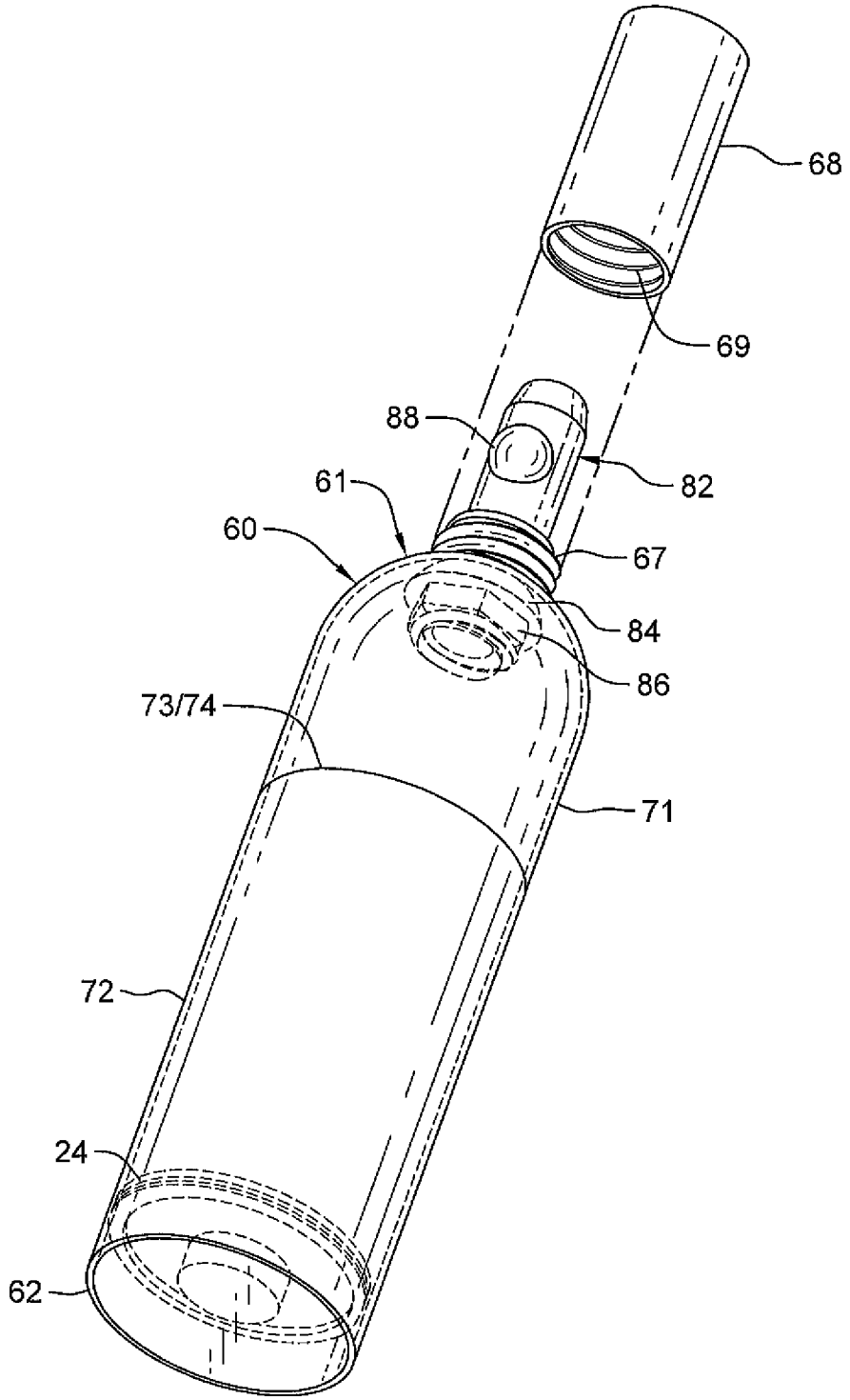
FIG. 3A is a perspective view of an embodiment of a plastic liquid container and dispensing system of the invention.
Figure 3B:
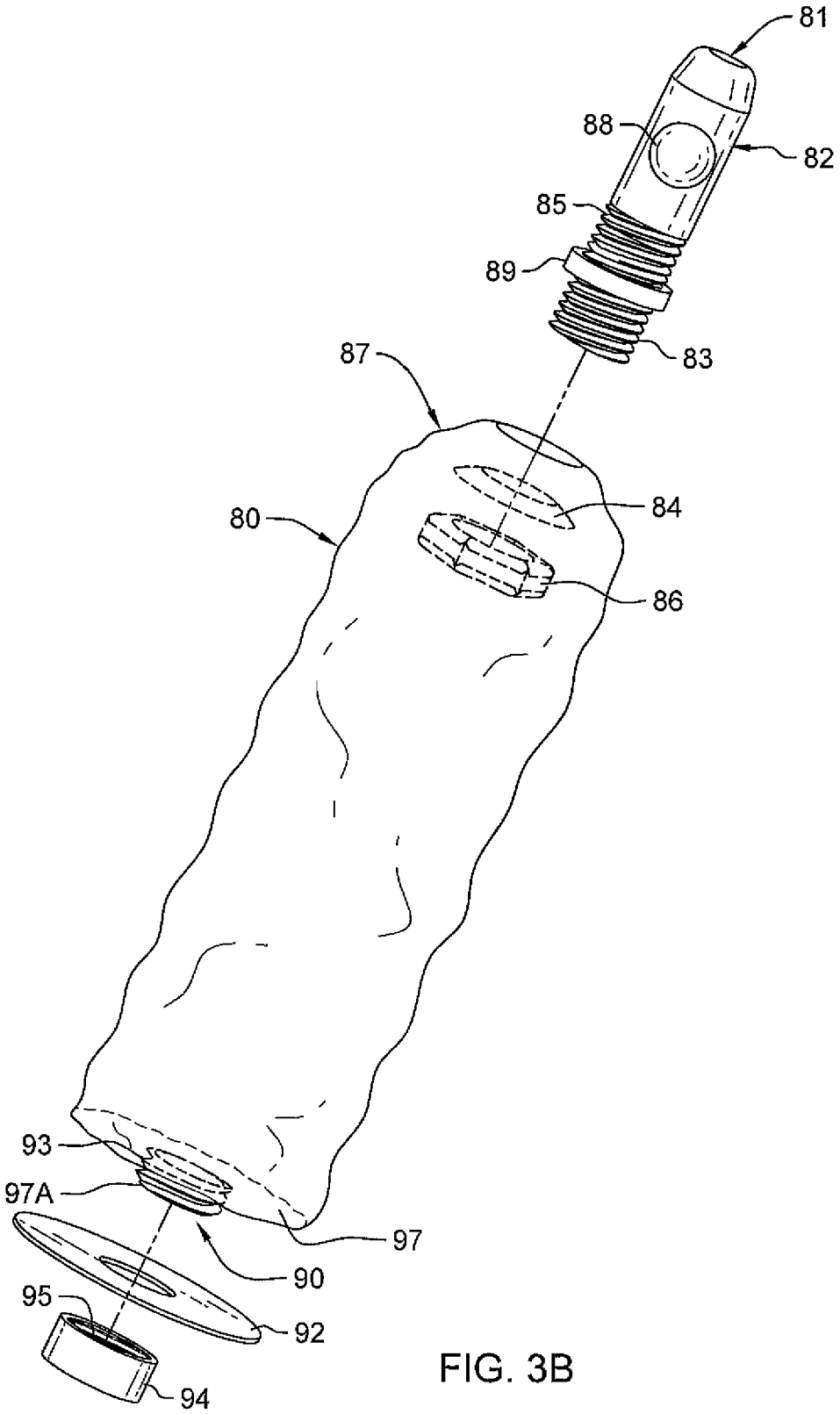
FIG. 3B is an exploded view of the plastic insert or bladder used in the dispensing system of FIG. 3A.
Figure 3C:
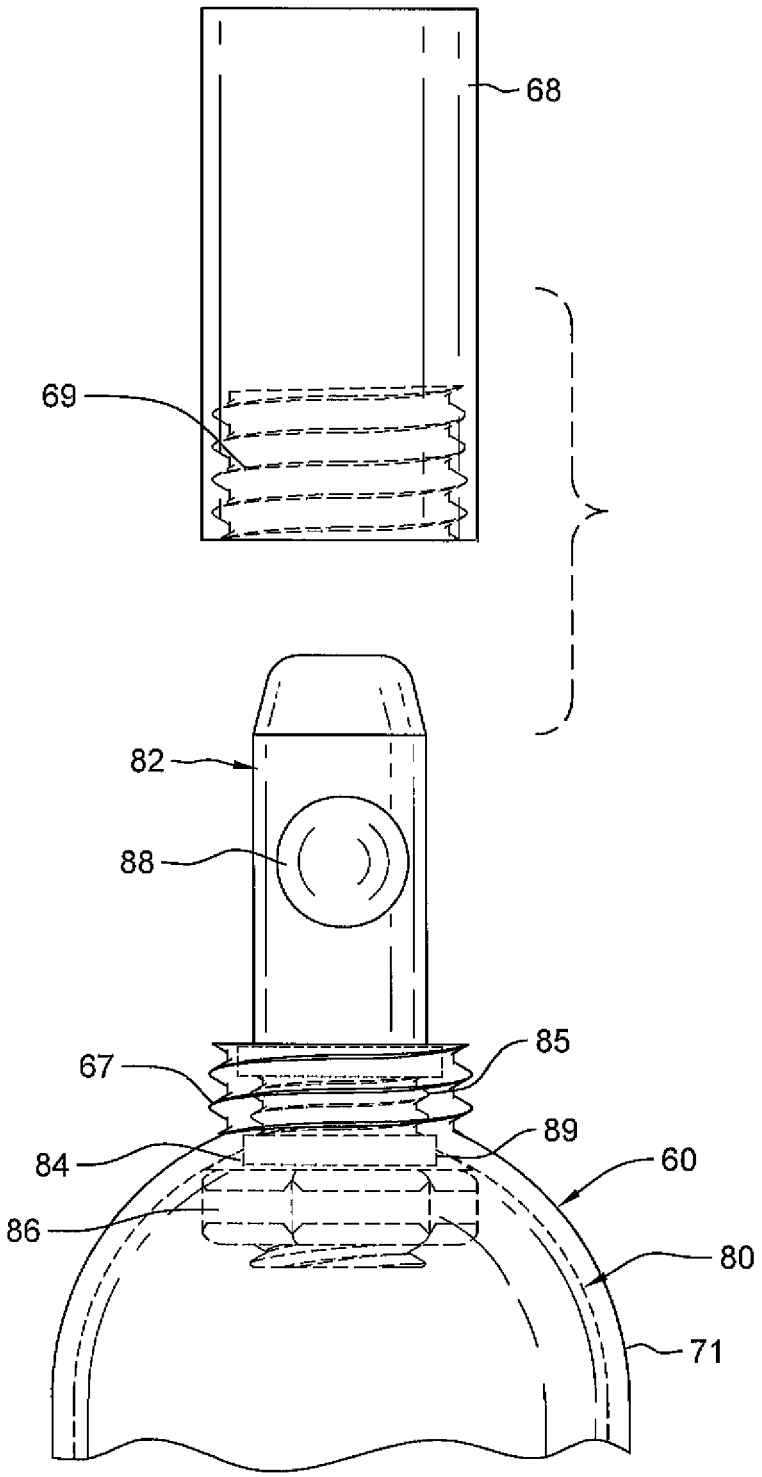
Figure 3D:
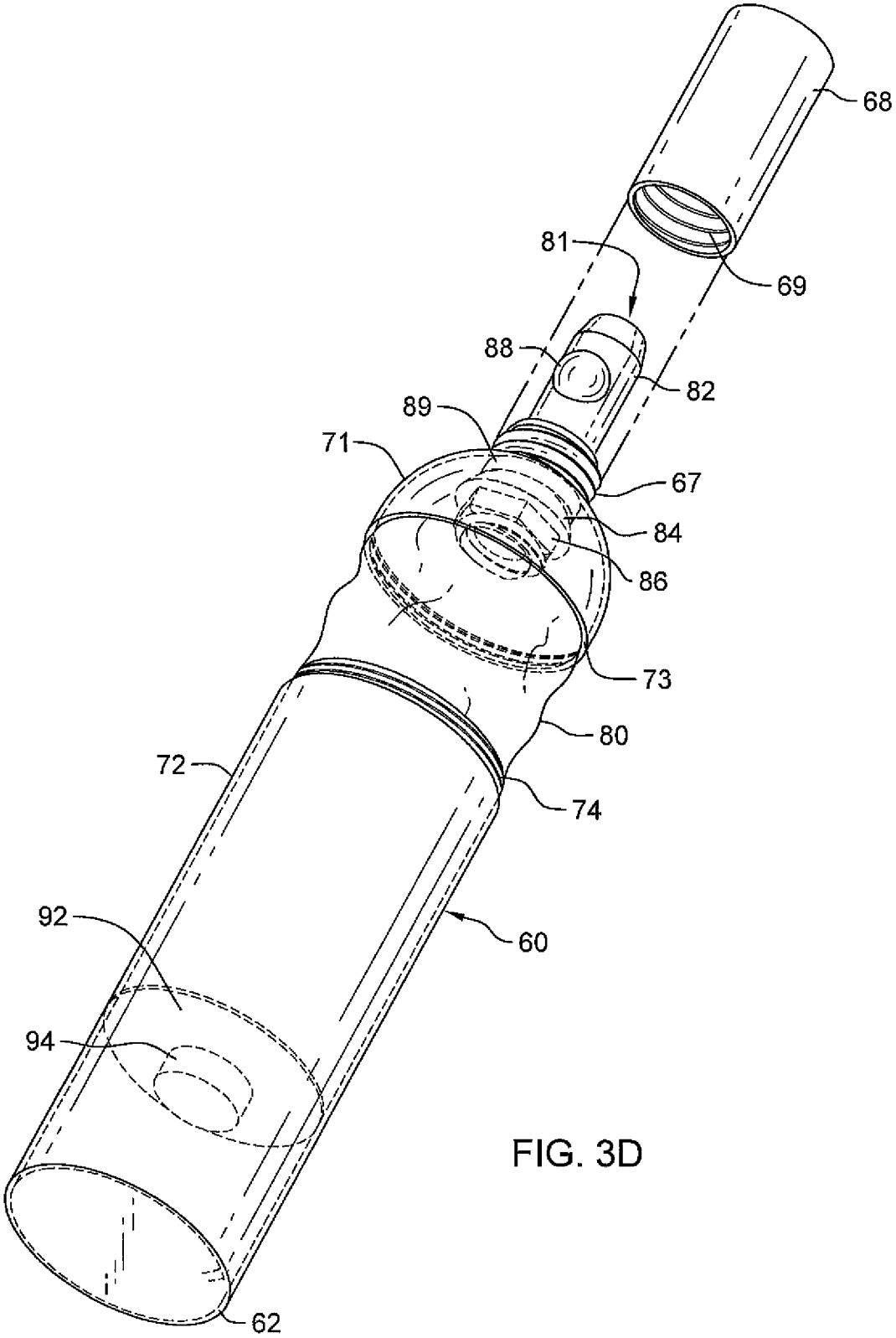
Figure 3E:
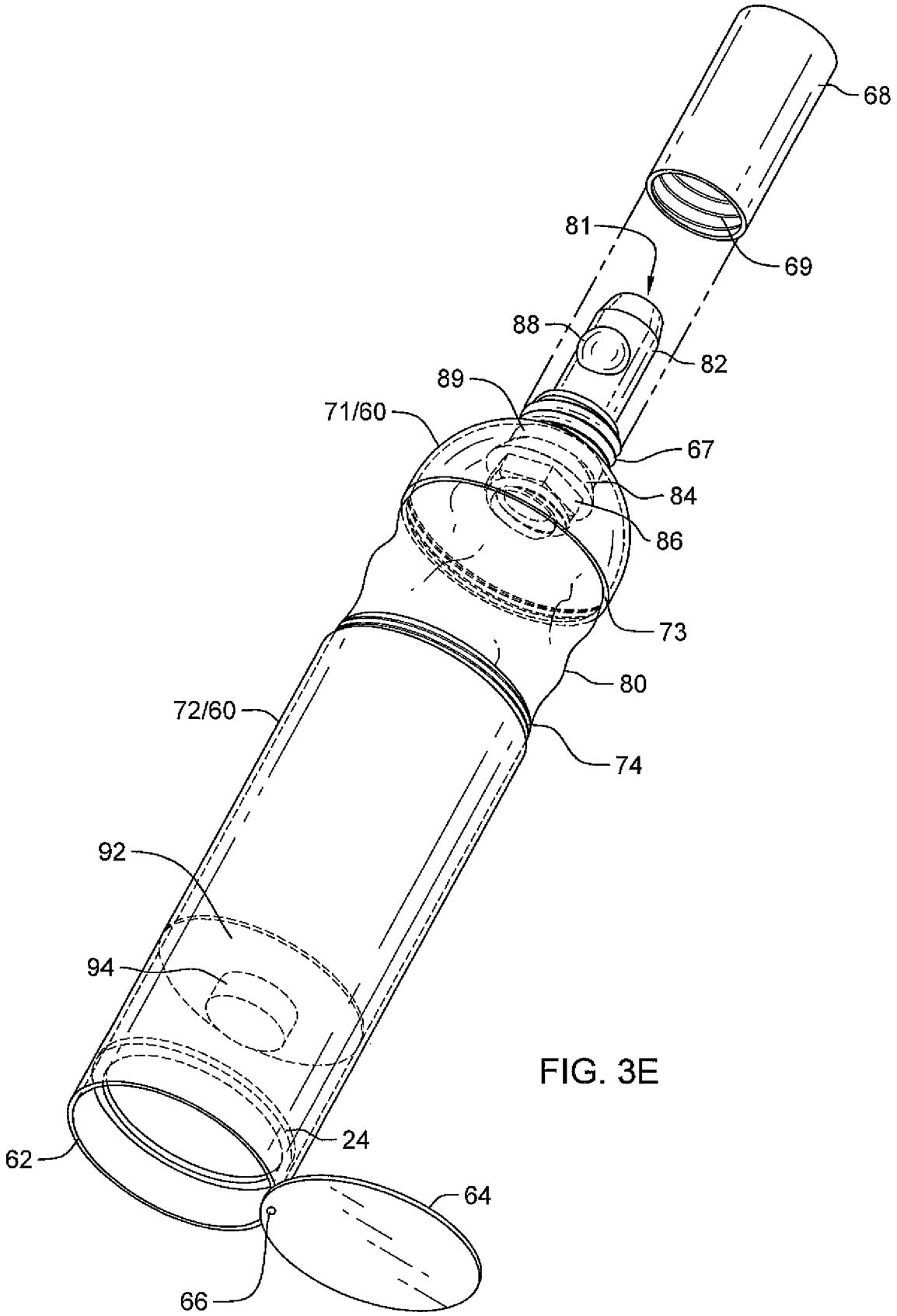
Figure 4A:
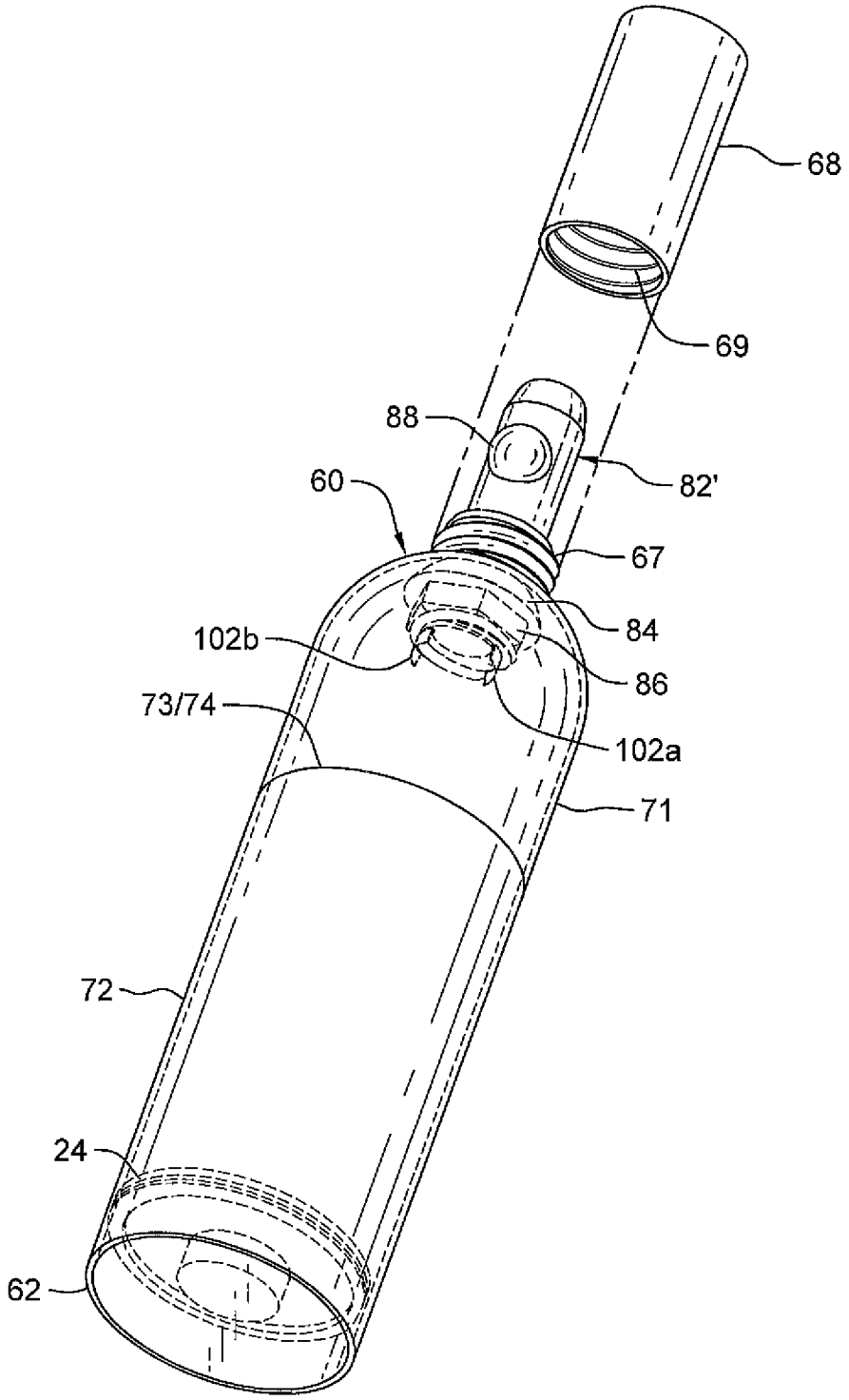
Figure 4B:
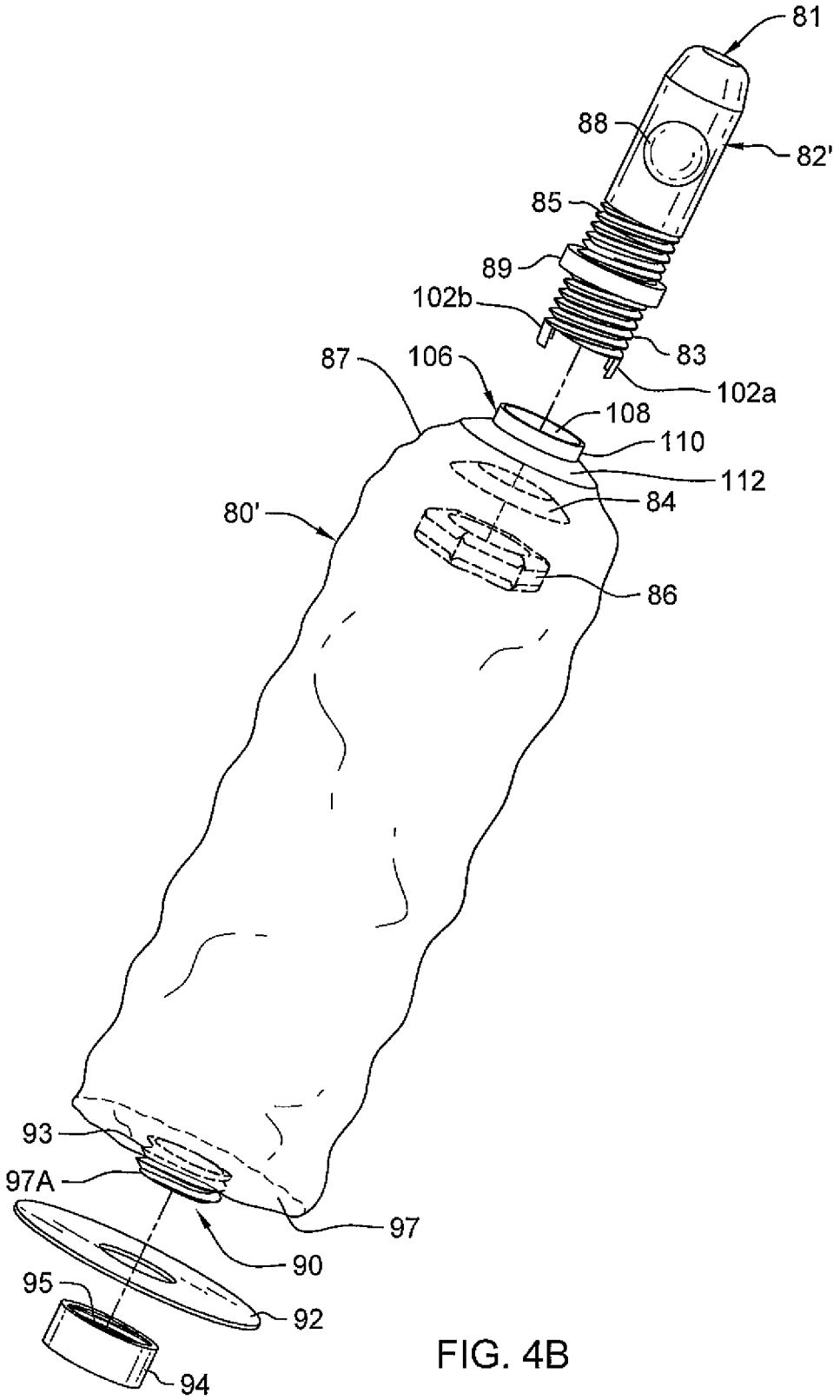
Figure 4C:
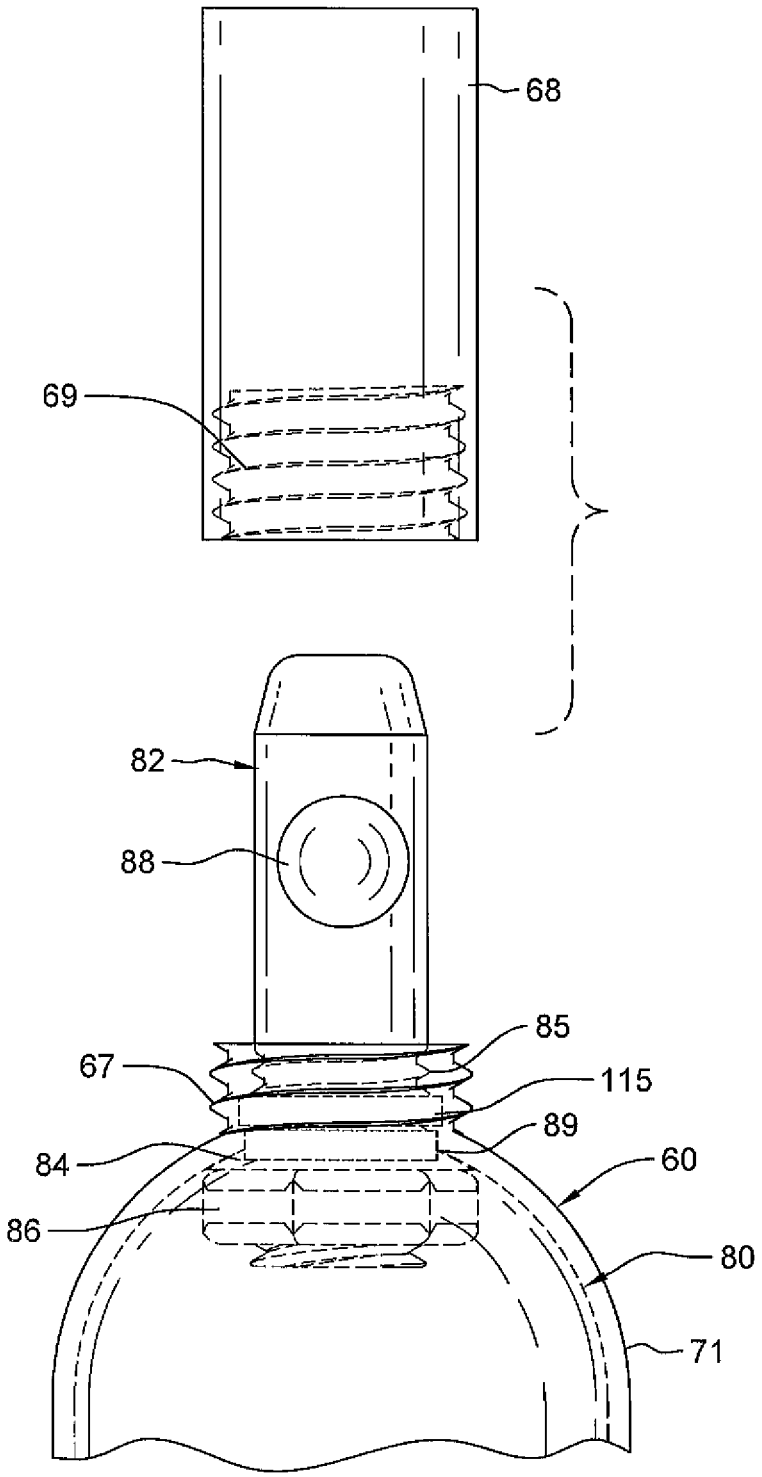
Figure 4D:
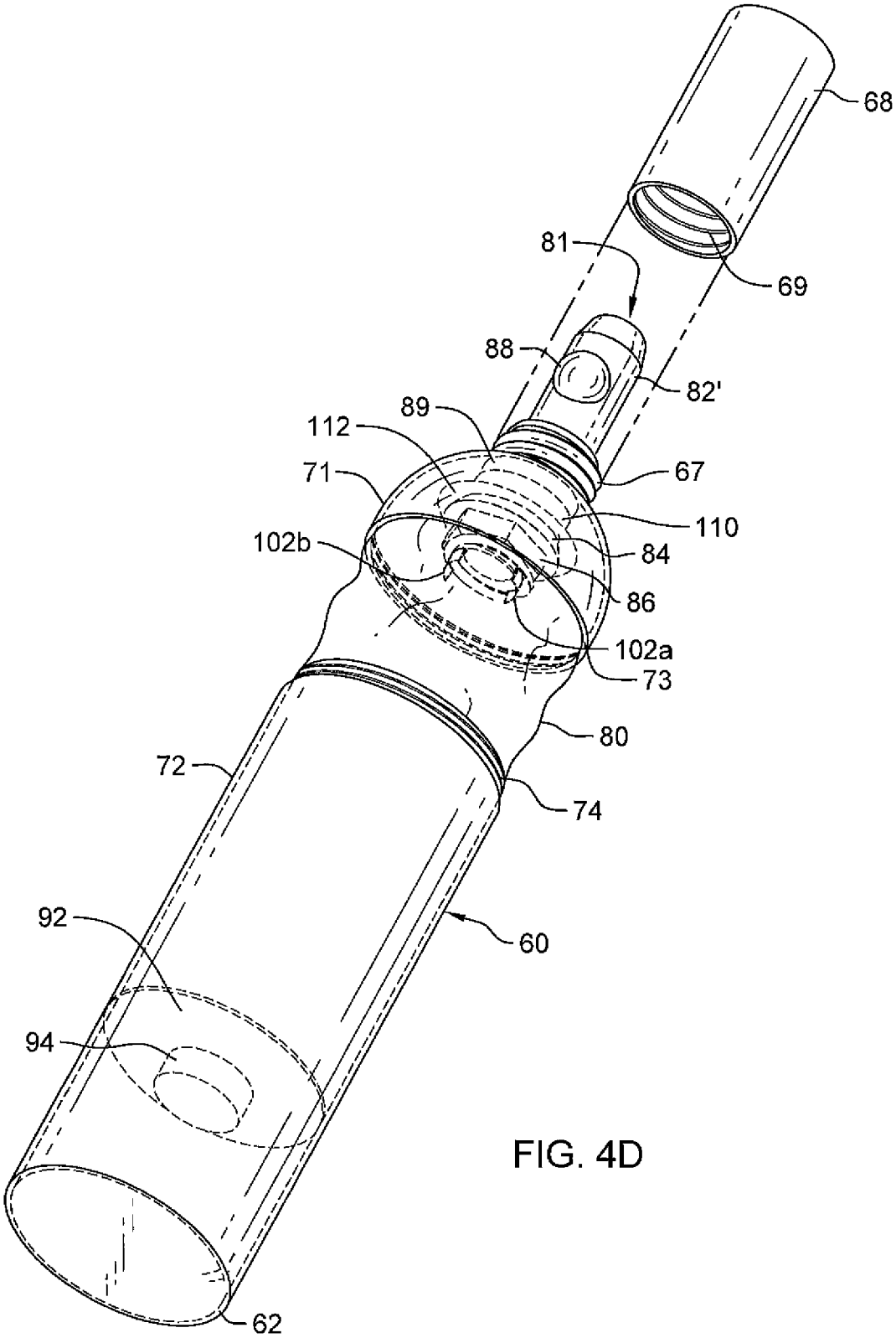
Figure 4E:
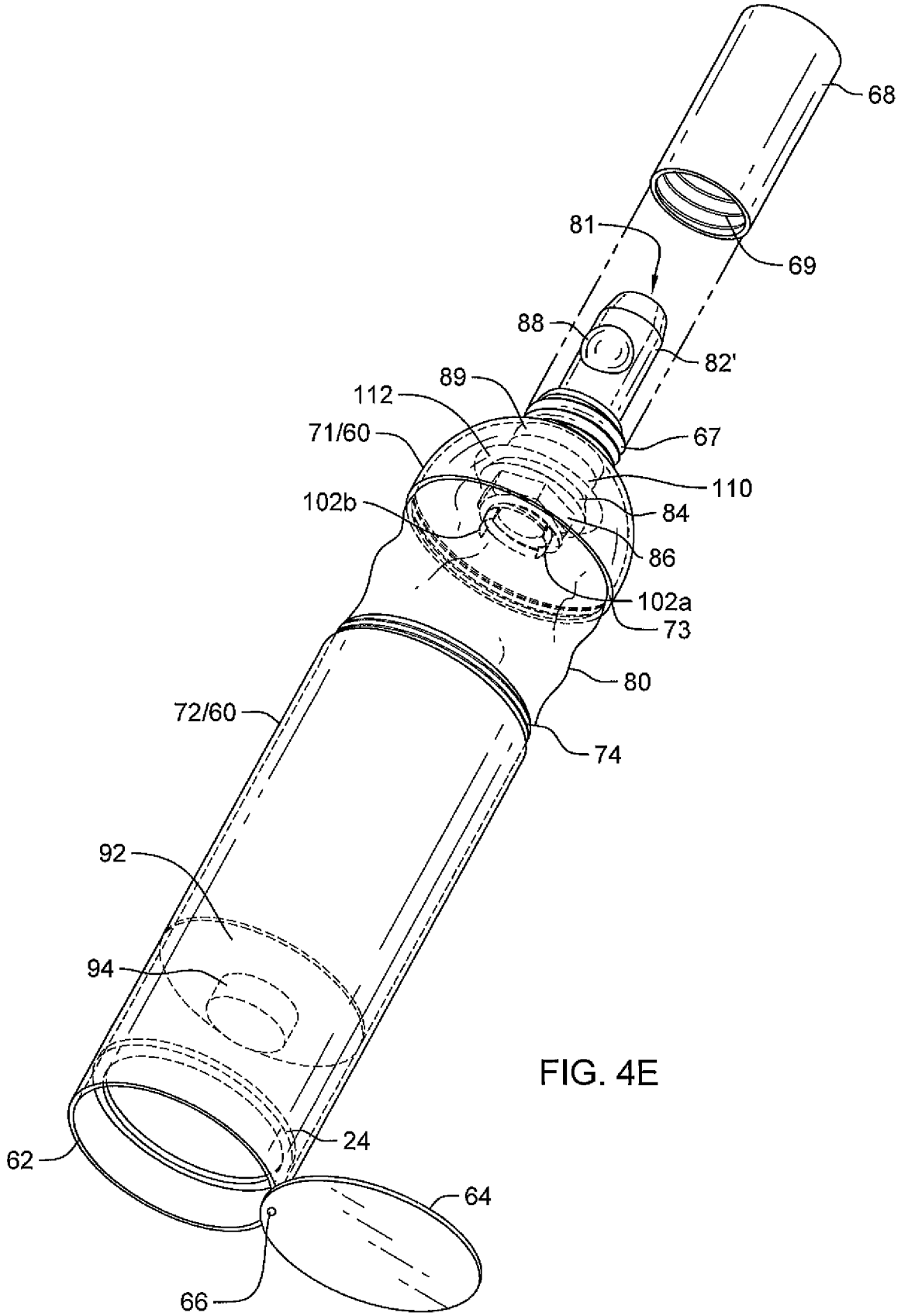

FIG. 3C presents a detailed view of the top of the plastic liquid container and dispensing system of FIG. 3A;

FIG. 3D is an exploded perspective view of an embodiment of a plastic liquid container and dispensing system of the invention of FIG. 3A;

FIG. 3E is an exploded perspective view of an embodiment of a plastic liquid container and dispensing system of the invention of FIG. 3A, that opens to provide access to the insert or bladder from the bottom;

FIG. 4A is a perspective view of an embodiment of a plastic liquid container and dispensing system of the invention, where the bladder opening comes with a cover to seal the bladder and the spout includes a cut to cut the opening and create a liquid flow path;

FIG. 4B is an exploded view of the plastic insert or bladder used in the dispensing system of FIG. 4A;

FIG. 4C presents a detailed view of the top of the plastic liquid container and dispensing system of FIG. 4A;

FIG. 4D is an exploded perspective view of an embodiment of a plastic liquid container and dispensing system of the invention of FIG. 4A; and FIG. 4E is an exploded perspective view of an embodiment of a plastic liquid container and dispensing system of the invention of FIG. 4A, that opens to provide access to the insert or bladder from the bottom.

DETAILED DESCRIPTION OF THE INVENTION

The following is a detailed description of example embodiments of the invention depicted in the accompanying drawings. The example embodiments are in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

Using the inventive plastic liquid container and dispensing system is simple, easy and advantageous. Assuming the bladder is new, simply, fill; that is, the bladder, presumably, is initially air-free and preferably disposable; the bladder may be filled with wine or other beverage at the sealable opening at the top of the bladder.

Thereafter, the spout is affixed to the bladder (and preferably with a gasket between the locknut and spout or a flange on the spout), to form a seal at the top. Ideally, the locknut and gasket are secured to/within the bladder when manufactured. Alternatively, the spout, locknut and gasket are secured to the bladder when manufactured. Alternatively, when manufactured, the spout may be connected to the bladder, together, and the bladder may be filled from the bottom through an opening (that is then capped), may be placed into the bottle through its base (see below), and secured to the plastic bottle at its top, by threads on the outside of the spout to threads within the top of the bottle.

These alternatives do not encompass all alternatives and it is the intent of this inventor to encompass all alternatives without listing every alternative embodiment.

In any event, the user fills the bladder with the user's preferred beverage, such as his/her favorite wine, at the top of the bladder through an opening (or bottom in the alternative embodiment), which has a larger opening than a traditional wine top, for easier filling, and when filled, the spout is secured at the top of the bladder.

In the first embodiment shown, the user attaches the spout (whether the bladder is filled or not, depending on the embodiment) by turning the connecting end of the spout so that the threads thereon cooperate with the threads on the inner surface of the flow channel through the locknut (integrally formed or permanently connected to the bladder). The filled bladder with the spout connected thereto is then placed into the plastic bottle.

The plastic bottle is unscrewed, separating the top portion and bottom portion, connected by threads (inner threads for the top, and outer threads for the bottom portion). The filled bladder is then placed into the bottom portion of the bottle; the spout (connected to the bladder) is then connected to the top portion of the plastic bottle; the top portion (connected to the spout and bladder) is then connected to the bottom portion to the bottle, to complete. Conversely, depending on user preference, the top portion of bottle may be secured to the spout (connected to the bladder) and then placed into the bottom portion of bottle, and secured, to complete. A cap may be utilized over the spout to protect the spout from debris and prevent leaking.

After the filled bladder and spout is enclosed within, and connected to the bottle, it may be transported or stored until ready for use, i.e., pouring wine (liquid access). To access the bladder (wine or any liquid), the bottle portions are unscrewed; the spout in unscrewed from the top portion of bottle, and the spout in unscrewed from the bladder locknut.

Once the component parts are secured, and ready to use, the bottle is held to pour; while over a glass, the spout button is pressed. When pressed, the liquid from the bladder then flows through the opening in the lock nut into the flow path through the spout and out the spout opening. After filling a glass or other container for use, the spout button is released, and the spout capped (if desired).

When a bladder becomes empty from use, the bottle is unscrewed. The spout and bladder are removed from the bottom of the bottle; the top portion of bottle is unscrewed from the spout. The spout is unscrewed from the locknut and bladder. The bladder may be recycled or refilled (if it's the same wine, perhaps), or disposed of, and replaced with a new bladder. If disposed of, a new bladder may be filled according to the above procedure. In the case of wine, a user's favorite wine will stay fresh twice as long (or longer) without any toxins leaching therein. The bottle and filled bladder may be transported in a cooler, on the floor of a car, etc., and transported into venues where no glass bottle might otherwise be allowed.

In another, alternative embodiment, simply open the bottom of the bottle by swiveling the bottle base cap (in a bottom-access embodiment) and remove the bladder to fill. Alternatively, the bladder may be filled without removing it from the bottle, if the spout is connected. In an alternative embodiment, the spout is accessed through the top of the bottle. A part of the bottle near or at the top separates from a lower part of the bottle, to allow the bladder and spout to be inserted into an inner bottle volume. The spout passes through and fixed in an opening at the top of the bottle, as the two bottle parts are reconnected. A bottle top cap may be placed over the spout and affixed to the bottle. Please note that the bladder is an insert with respect to the bottle, so that the terms "bladder" and "insert" are used interchangeably herein.

The bladder may be filled with wine or other liquid beverage at the "bottle-like" sealable opening (with a standard cap or air-escaping cap) at the top of the top-access bladder, or alternatively, at the bottom of a bottom-access bladder, as described, after the spout is secured to the bladder at the locknut in either case. While the bladder may be filled through the circular opening before the spout is secured, whether a top-access or a bottom-access embodiment, it is preferable that the bladder is not filled until/unless the spout is affixed (and preferably with a gasket between the locknut and spout), to form a seal. Ideally, the locknut and gasket are secured within the bladder when manufactured. The spout is then placed through the gasket (located either at the top or bottom) and the locknut is secured/screwed (by hand) to the spout. Alternatively, the locknut and gasket, and the spout, are secured to the bladder when manufactured, and the spout inserted into the bottle in which it is intended to be used.

Once the spout is secured at the bottom or top, the bladder is filled through a corresponding opening at the top or bottom of the plastic bottle. In the case of a bottom fill, the bottle preferably has a planar bottom part that is flipped open or slid 180 degrees about a hinge (internal). Preferably, when closed, the bottle bottom exhibits a liquid seal. In the case of a top fill, the bottle has a larger opening than a traditional wine top, for easier filling, and when filled, a sealing member, such as a common cap, is secured to seal the fill-opening in the bottom.

Figure 1:
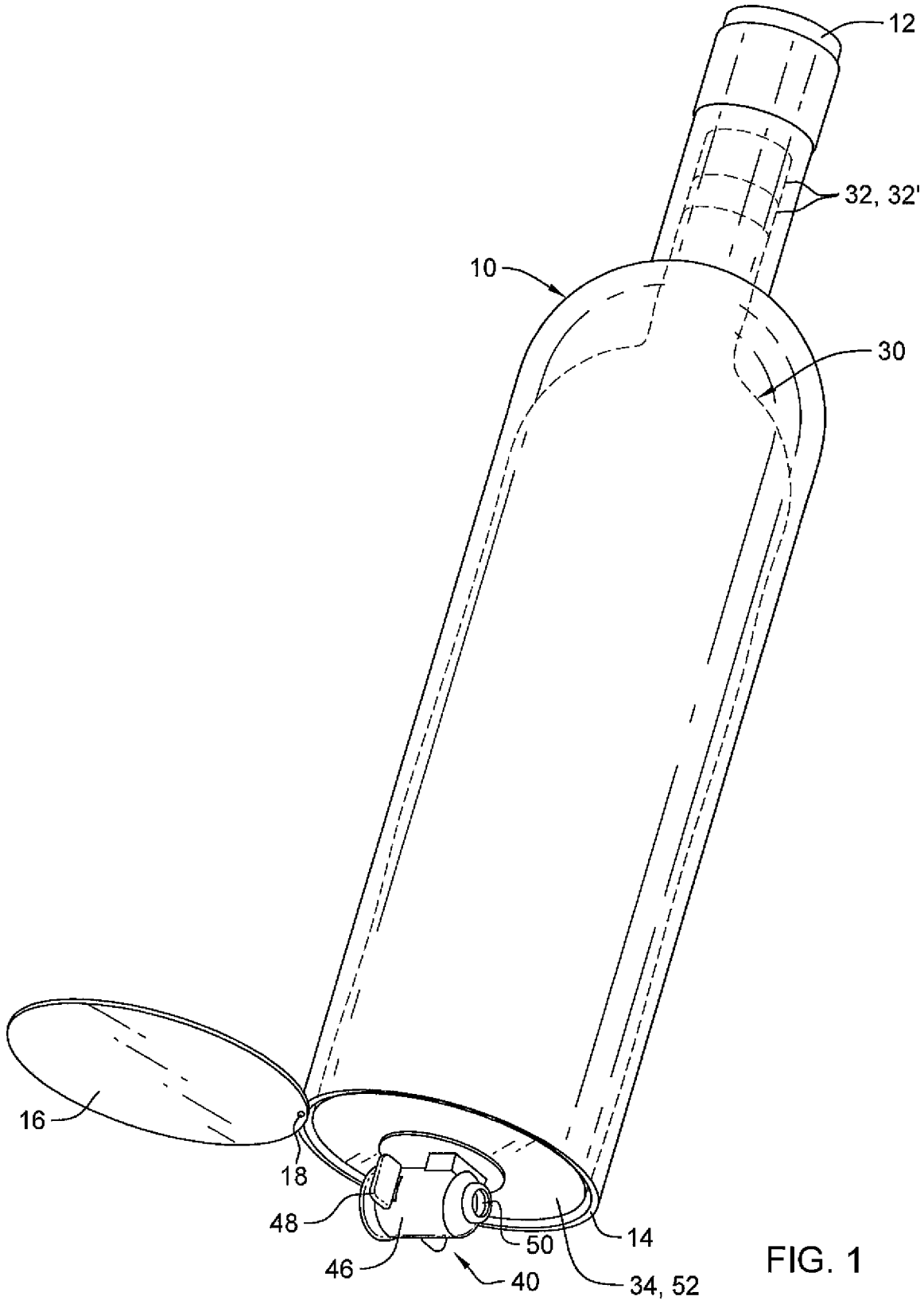
FIG. 1 is a perspective view of an embodiment of a plastic liquid container and dispensing system of the invention.
Figure 2A:
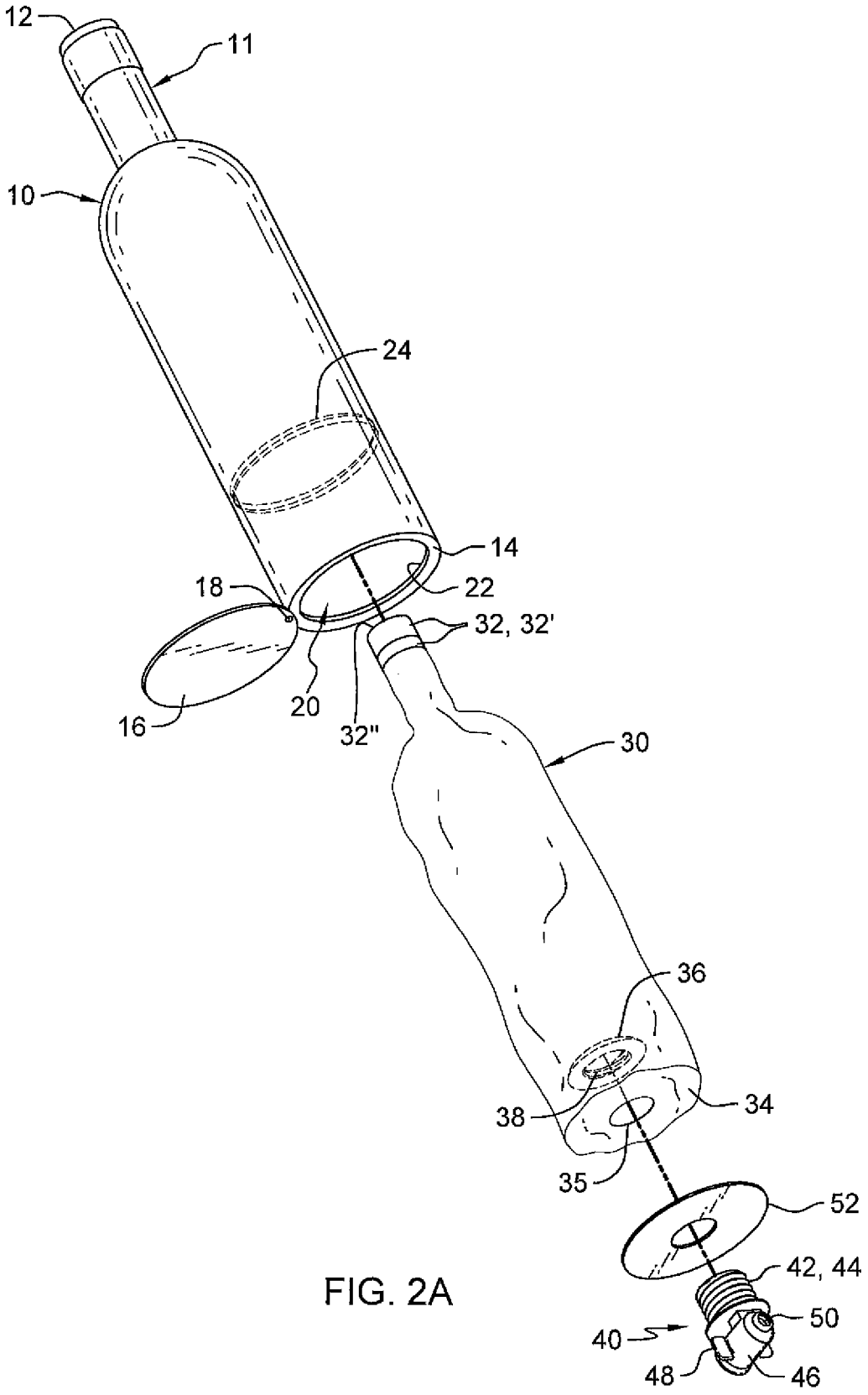
FIG. 2A is an exploded view of the plastic liquid container and dispensing system of FIG. 1.
Figure 2B:
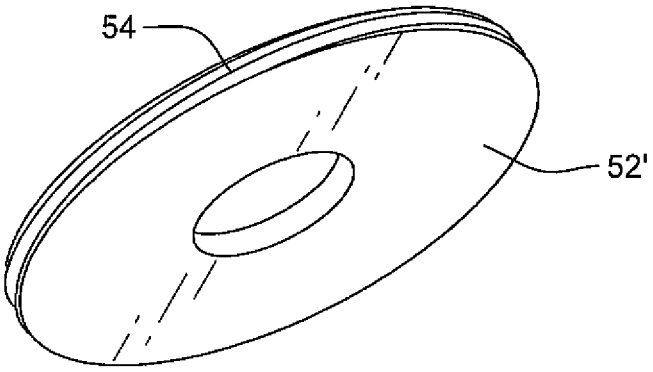
FIG. 2B is an alternative embodiment of a gasket.

FIGS. 1, 2A and 2B, together depict a bottle 10 with a bladder 30 (with bladder top 32, which includes an opening 32" in the bladder top and/or bladder top cap 32'). The bladder is inserted into the bottle 10 and accessed through a base (bottom) 14 of the bottle 10, according to a first embodiment of the invention. The bottle 10 has a top 11, a top cap 12, a bottle base cap 16 that swivels open and closed about a bottle base cap (inner) pin (or hinge) 18, to provide access through a bottle base opening 20 to an inner bottle volume. The bladder in inserted or removed through the bottle base opening 20. In the embodiment shown, the user attaches a spout 40 (whether the bladder 30 is filled or not) by turning a connecting end 42 of the spout 40 so that the threads 42 thereon cooperate and connect with threads 38 on an inner surface of a bladder locknut 36, positioned in the bladder 30 (FIG. 2A). Outside the bladder base 34, the spout connecting end 42 first passes through a disk-shaped gasket 52, then passes through a circular opening 35 in the bladder base and threadedly connects to the bladder locknut 36.

The spout 40 includes an internal flow channel, extending from and through the connecting end 42, through the spout body 46, and to a spout port 50. After the spout 40 is connected to the bladder locknut 36, integrally formed or permanently connected to the bladder 30, it may be filled. While the bladder may be filled though port 50 when in an open state by actuating spout fluid release button 48. However, it may be preferable to fill the bladder 30 via an opening in bladder top 32, after removing cap 32'. The filled bladder 30 with the spout 40 connected thereto is then pushed into (or back into) the bottom of the bottle 10.

Preferably, the radial extent of the gasket 52 may be substantially the same as the inner radial dimension of bottle 10, and a lip or rim formed at the base of the bottle, with sufficient radial extent and gasket flexibility and resiliency so that the plastic gasket 52 can be bent slightly to be pushed pass the lip, and straightened to sit thereon, and maintain the gasket 52 and bladder 30 in the bottle at the base.

Alternatively, a rim or other means for maintaining the filled bladder within the bottle during intended use, is included. For example, a gasket 52' may be a relatively more rigid than gasket 42 (but still able to be bent to fit through the base of the bottle), including cylindrical sides of the disk 52' formed with a thread-like extension 54 along its outer cylindrical surface, along an axial extent thereon. A complementary threadlike extension 24 is provided (for a like axial extent) on the inner surface of the bottle, proximate its base end, preferably (FIG. 2A may not be drawn to scale). As such, turning the bladder approximately ¼ turn, once positioned in the bottle, will attach the gasket 52' to the threads 24, at the fixed position at or set off from the base 14 of the bottle, proximate (and sufficiently recessed) from the bottle base end. Alternatively, rather than thread-like extensions on the gasket and inner surface of the bottle, the gasket may be indented to match notches on the inner surface of the bottle, or by friction fit. In any event, as long as the gasket is sufficiently recessed away from the end of the bottle base, the bottle base-cap may be swung (or swiveled) to close the bottle and enclose the bladder and spout.

In such an embodiment, it may be unnecessary to include the lip or inner edge in the bottle base 14 if the spout 42 is of sufficient length to be utilized when the base is open, i.e., the bottle base cap 16 is swung open about hinge 18 to realize opening 22. Though, in the notch-and-indent alternative, or form-fit embodiment (mentioned above), the lip may be utilized. Or, alternatively, in the threaded alternative (also mentioned above), a thread-like extension may be utilized at the base (substituted for the lip and in addition to the thread-like extension 24 on the inner surface of the bottle). In that case, the bladder 30 may be turned, pulled down towards the bladder base 34, and then turned approximately ¼ turn to secure the disk 54 at the base and utilized.

After the filled bladder 30 is enclosed in the bottle 10, the bottle may be transported or stored until ready for use, i.e., pouring wine (liquid access). To access the wine (or any liquid), the base cap 16 is opened (flipped about hinge or swivelled about a pin) away from the cap's closed position at the bottom of the plastic wine bottle. Then the spout 40 is pulled down through the bottle base 14 and the gasket 34, 52 is fixed in place at or near the base rim and a spout fluid release button 48 is pressed. The liquid from the bladder 30 then flows through the opening in the lock nut into the flow path through the spout and out the spout opening 50 (for filling and accessing the liquid), for example, to fill a glass of Pinot Noir. After filling a glass or other container for use, the spout 40 is pushed back up into the bottle 10 and the bottle closed by swiveling (or swinging or rotating) the bottle base cap 16 so the bottle (when closed) may rest on any flat surface, i.e., countertop/bar-top.

When a bladder 30 becomes empty from use, the bottle base cap 16 is swiveled open to access the spout 40, and bladder 30 attached thereto. The spout and bladder are removed from the bottle 10 through its bottle base 14 by turning and/or pulling the bladder 30 out of the bottle. The spout 40 is unscrewed from the bladder locknut 36; the locknut should be sufficiently flexible and resilient to be passed through the circular opening at the top of the bladder (or discarded with the bladder if manufactured together) and may be cleaned along with the spout. The bladder may be recycled or refilled (if it's the same wine, perhaps), or disposed of, and replaced with a new bladder. If disposed of, a new bladder 30 may be filled according to the above procedure.

Notably, FIGS. 3A, 3B, 3C and 3D together depict another and most preferred embodiment of the plastic liquid container and dispensing system of the invention, where the bottle separates in two parts for bladder access. In this embodiment, a bladder 80 with a bladder fill-opening 90 is located at the bottom or base 97 of the bladder. But the bladder fill opening 90, gasket 92 and cap 94 may be eliminated entirely, in an alternative bladder embodiment, where the user fills the bladder through the bladder opening at its top 87 before the spout 82 is secured, or through the channel in the spout and gasket after the spout is secured. And of course pre-filled bladders may be utilized if available, obviating a need to fill the bladder at all.

In the embodiment shown, the bladder base 97 is proximate a base 62 of bottle 60, when the bladder is inserted into and positioned in the bottle. While the bottle 60 may include a bottle base cap 64, and a hinge 66 to allow for access into and out of a bottle inner volume (in the FIG. 3E embodiment), the bottle embodiment 60 depicted together by FIGS. 3A, 3B, 3C and 3D is formed in two separate parts, obviating a need for base cap 64 and hinge or pin 66 in the system embodiment shown. That is, first bottle part 71 (which includes a top 71 of the first bottle part 71) and second bottle part 72 are connected together, and disconnected, by use of complementary threads 73, 74 in connecting ends of the respective first and second bottle parts (FIG. 3D). This allows for a simpler embodiment than the embodiment requiring the bottle base cap and hinge (FIG. 3E). For that matter, complementary threads 73, 74 are not necessary, as the connecting ends of the top and bottom bottle parts 71, 72, may be formed to that one slips into the other and maintained by friction.

FIG. 3B is an exploded view of the plastic insert or bladder 80, used in the plastic liquid container and dispensing system. Bladder 80 includes a bladder spout 82, with an opening 81, a liquid release button 88, first connecting means comprising threads 85 on an outer circumferential surface of the spout 82' that complement threads on an inside surface of the neck of top bottle part 71, a lip or flange 89, second connecting means comprising threads 83 on an outer circumferential surface of the spout, just below the lip or flange 89, which complement threads on a spout locknut 86, (which connects to the bladder 80) and a spout gasket 84, are arranged proximate the top of the bottle 60, as shown. As shown in FIG. 3C, the spout's first connecting means 85 allows for detachable connection (at least ¼ turn, but preferably ½ turn, or until contact with the lip or flange 89), to inner threads on an inner surface of the neck bottle (not shown), and which should be between ½ turn and 2 full turns. The inner threads on the inner surface of the bottle 71 may be positioned anywhere along the inner surface of the top neck of the bottle, for example, at the top proximate the upper extent of outer threads 67 on the outer surface of the bottle top neck, as shown in FIG. 3C.

Alternatively, the inner threads on the inner surface of the bottle may be positioned anywhere along the vertical extent of the outer threads 67, but on the inner surface as opposed to the outer surface, or just below the lower vertical extent of outer threads 67. The outer threads 67 of the botte top neck complement the inner threads 69 of a bottle top cap 68. The spout 82 is preferably connected to the inside of the bottle 60 at the bottle top neck to prevent it from being pushed into the bottle accidently. In addition to the spout's second connecting means comprising threads 83 connects the spout 82 to the bladder 80 inside the bottle 60. Liquid flows through a liquid flow channel. The flow channel extends between an opening in the locknut 86, gasket 84 an inner channel passing external threads 83, spout flange 89, external threads 85, continuing past the liquid release button 88 and out the spout opening 81. Liquid flows either way when the release button is pressed.

Optional fill-opening 90 in the bottom or base 97 of the bladder 80 is closed with a disk gasket 92 and gasket end cap 94. End cap 94 includes female threads 95 that complement male threads 93 of a bladder port element 97A, that is integral with and extends from the bladder base 97. Liquid may be filled or released though an inner channel of the bladder port element 97A. In this case, the inner-lip or threads 24 or notches (as described above in the first embodiment shown, are optional in this embodiment). Alternatively, the spout does not have a release button at all, but rather its flow channel runs the length of the spout and the spout is sealed by a plug or cap that prevents or stops liquid from pouring out at the top of the spout, which obviates the need for a bottle cap.

In an alternative bladder embodiment, there is no bladder port element 97A integral with and extending from the bladder base 97. In that case of course, there is no bladder end cap 94 or need for disk gasket 92.

As is the case, the spout 82 is secured to the bladder 80 at the top of the bladder in reliance upon the locknut 86 and gasket 84 inside or affixed to the bladder. The locknut 86 and gasket 84 seal the gasket circular opening against the spout lip or flange 89. The user removes the fill-cap 94 at the bladder base and fills the bladder 80 with wine or other liquid; the user then caps 94 the fill-opening 90. But as mentioned above, the user has an option to fill the bladder though the opening at the top of the bladder before the spout is attached or through the spout if the spout is already attached. The plastic bottle 60 is then inverted.

Alternatively, the user separates the bottle 60 into its upper and lower parts 71, 72, and places the preferably already filled bladder 80 into the inner-body of the lower part 72 of the plastic bottle 60, spout-up. As the upper part 71 of the bottle is placed over the upper part of the bladder 80, the spout 82 then passes through the opening at the top of the bottle. The spout 82 and bladder 80 are connected to the plastic bottle 60 by screwing the spout 82 into the bottle 60 against spout flange 89. The spout 82 then completes the neck of the plastic bottle 60. The user closes the base 64, 66. Alternatively, the spout may be connected to the bottle top by use of an outer locknut rather than threads on/in the bottle top, for example, the bottle top may be passed over and through a circular opening in the bottle top, slightly larger than the circumference of the spout and then a locknut is passed over and through and down the spout and secured to the spout by threads. Now, you're ready to go!

The user pours the liquid contained in the bladder (now connected to the bottle) by turning the plastic bottle over and pressing the release button 88 on the spout 82 (or other means such as removing a plug or a cap; the liquid passes from the bladder 80 through a channel formed through the upper spout locknut 86, the spout gasket 84, an inner channel through a body of the spout 82 and out opening 81 and into a glass or cup. Bottle top cap 68 (with a length equivalent to a length of the spout 82) may be placed over the spout 82 and secured, to either the spout of the bottle by threads, or pressure (i.e., a friction fit) for mess-free use.

Once the bladder 80 is empty, then simply unscrew the cap 68, and then unscrew the spout 82 from the bottle 60, invert the plastic bottle 60, separate or disconnect to two parts of the bottle (or open the base by swiveling base cap 64 about hinge 66 in the alternative embodiment of FIG. 3E). The user then pulls out the empty bladder 80, unscrews the spout 82 from the bladder 80, cleans the spout 82 and bottle 60 (if you wish), and replaces the bladder with a new, air-free one, or reuses the bladder 80 by repeating the steps above! Alternatively, a new bladder 80 and/or all its parts may be employed, filled and replaced in the bottle.

FIG. 3E is an exploded perspective view of an embodiment of a plastic liquid container and dispensing system of the invention of FIG. 3A, that opens to provide access to the insert or bladder from the bottom. The FIG. 3E embodiment, however, is constructed so that the bottle may be separated into two parts 71 and 72. The preferably filled bladder may be inserted through an opening in the base 62 when the bottle base cap 64 is flipped open about inner hinge 66 or slid off the outer surface of the bottle base 62, 180 degrees about the hinge or pin 66, as shown. When inserted through an opening in the base 62, the bladder should be recessed sufficiently within the bladder so that the fill-opening 90 and cap 94 would clear the base 62 of the plastic bottle 60, so it may be closed. This is accomplished in reliance upon the disk gasket, with threads included to complement threads 24 on an inner surface of the lower part 72 of bottle 60. Once the spout 82 is connected to the top of the plastic bottle 60, the base end 97 of the bladder may be sufficiently recessed so the bottom of the bottle base may close without and contain the bladder therein without issue.

FIGS. 4A-D depicts yet another embodiment of the inventive plastic liquid container and dispensing system of the invention. In the embodiment shown, the bottle separates in two parts 71, 72, for bladder access. While a bladder 80 (FIG. 3) may be filled through an opening at the top 87, bladder 80' of FIGS. 4A-D is meant to be replaced when the liquid supply therein is exhausted. Pre-filled bladders 80' as purchased are preferably filled with a desired liquid such as wine. The top 87 of the filled bladder has an "wine-access" opening 108 that is sealed with a cover 106, using a thin film or metal foil material 112, sufficient to seal the wine in (as known to the person of ordinary skill in the art). A bottom of a threaded part of the spout 82' comprises a cutter 102, or a pair of cutters 102*a*, 102*b*, for use in cutting through the covering material 112, as the bottom of the spout 82' is pushed into the bladder and connected thereto.

While this embodiment depicts bladder 80' with a bladder fill-opening 90 located at the bottom or base 97 of the bladder, said bladder fill opening 90, gasket 92 and cap 94 may be eliminated entirely. In this case, the user fills the bladder 80' through the bladder opening 108 at its top 87 of the bottle before the spout 82' is secured, or through the channel in the spout 82' and gasket 92 after the spout is secured. The bladder base 97 is proximate a base 62 of bottle 60, when the bladder 80' is inserted into and positioned in the bottle. The bottle may include a bottle base cap 64, and a hinge 66 to allow for access into and out of a bottle inner volume, for example, to fill or replace a bladder 80' (see FIG. 4E embodiment). The two bottle parts are connected together, and disconnected, by use of complementary threads 73, 74, or by friction fit. In either case, the bottle is assembled by connecting ends of the respective first and second bottle parts (FIG. 4D), which is simpler than the embodiment requiring the bottle base cap and hinge (FIG. 4E).

FIG. 4B is an exploded view of the plastic insert or bladder 80', used in the plastic liquid container and dispensing system. Bladder 80' includes a bladder spout 82', with an opening 81, a liquid release button 88, first connecting means comprising threads 85 on an outer circumferential surface of the spout 82' that complement threads on an inside surface of the neck of top bottle part 71, a lip or flange 89, second connecting means comprising threads 83 on an outer circumferential surface of the spout, just below the lip or flange 89, which complement threads on a spout locknut 86 (which connect to the bladder 80') and a spout gasket 84 arranged proximate the top of the bottle 60, as shown. The bladder 80' in this particular embodiment is purchased filled with a desired liquid such as wine.

The top of the filled bladder 80' has an opening 108 that is sealed with a cover 106, for example, using a thin metal foil material 112. A bottom of a threaded part of the spout 82' comprises the cutter 102, or a pair of cutters 102*a*, 102*b*, as known to the skilled artisan. The cutter(s) is/are used to cut through the covering material 112, as the bottom of the spout 82' is pushed into the bladder and connected thereto. To cut, the bottom of the spout is "turned" into the bladder top, where the blade(s) 102 cut the material as the blade(s) turn(s) to screw down the spout.

As shown in FIGS. 4B and 4C, the spout's first connecting means comprising male threads 85 on an outer circumferential surface thereof, allows for detachable connection (at least ¼ turn, but preferably ½ turn or until contact with the lip or flange 89), which allows for connection to inner threads on an inner surface of the bottle top (not shown), and which should be between ½ turn and 2 full turns. The inner threads on the inner surface of the bottle may be positioned anywhere along the inner surface of the top neck of the bottle 71, for example, at the top proximate the upper extent of outer threads 67 on the outer surface of the bottle top neck, as shown in FIG. 4C.

Alternatively, the inner threads on the inner surface of the bottle may be positioned anywhere along the vertical extent of the outer threads 67, but on the inner surface as opposed to the outer surface, or just below the lower vertical extent of outer threads 67. The outer threads 67 of the botte top neck complement the inner threads 69 of a bottle top cap 68. The spout 82' is preferably connected to the inside of the bottle 60 at the bottle top neck to prevent it from being pushed into the bottle. In addition to the spout's second connecting means comprising threads 83 on an outer circumferential surface connects the spout 82 to the bladder 80 inside the bottle 60. Liquid flows through a liquid flow channel. The flow channel extends between an opening in the locknut 86, gasket 84 an inner channel passing external threads 83, spout flange 89, external threads 85 continuing past the liquid release button 88 and out the spout opening 81. Liquid flows either way when the release button is pressed.

Optional fill-opening 90 in the bottom or base 97 of the bladder 80 is closed with a disk gasket 92 and gasket end cap 94. End cap 94 includes female threads 95 that complement male threads 93 of a bladder port element 97A, that is integral with and extends from the bladder base 97. Liquid may be filled or released though an inner channel of the bladder port element 97A. In this case, the inner-lip or threads 24 or notches (as described above in the first embodiment shown, are optional in this embodiment).

In an alternative bladder embodiment, there is no bladder port element 97A integral with and extending from the bladder base 97. In that case of course, there is no bladder end cap 94 or need for disk gasket 92.

The user pours the liquid contained in the bladder 80' (now connected to the bottle) by turning the plastic bottle over and pressing the release button 88 on the spout 82'; the liquid passes from the bladder 80' through a channel formed through the upper spout locknut 86, the spout gasket 84, an inner channel through a body of the spout 82' and out opening 81 and into a glass or cup. Bottle top cap 68 (with a length equivalent to a length of the spout 82') may be placed over the spout 82' and secured, to either the spout of the bottle by threads or by friction fit, for mess-free use.

Once the bladder 80' is empty, simply unscrew the cap 62, separate or disconnect from bottom portion of the bottle, then remove top portion from the spout and then unscrew the spout from the bladder. The user then pulls out the empty bladder 80', unscrews the spout 82' from the bladder 80', cleans the spout 82' and bottle 60 (if you wish), and replaces the bladder with a new, air-free one, or reuses the bladder 80' by repeating the steps above! Alternatively, a new bladder 80' and/or all its parts may be employed, filled and replaced in the bottle.

FIG. 4E is an exploded perspective view of an embodiment of a plastic liquid container and dispensing system of the invention of FIG. 4A, that opens to provide access to the insert or bladder from the bottom. The FIG. 4E embodiment, however, is constructed so that the bottle may be separated into two parts 71 and 72. The preferably filled bladder may be inserted through an opening in the base 62 when the bottle base cap 64 is flipped open about inner hinge 66 or slid off the outer surface of the bottle base 62, 180 degrees about the hinge or pin 66, as shown. When inserted through an opening in the base 62, the bladder should be recessed sufficiently within the bladder so that the fill-opening 90 and cap 94 would clear the base 62 of the plastic bottle 60, so it may be closed. This is accomplished in reliance upon the disk gasket, with threads included to complement threads 24 on an inner surface of the lower part 72 of bottle 60. Once the spout 82 is connected to the top of the plastic bottle 60, the base end 97 of the bladder may be sufficiently recessed so the bottom of the bottle base may close without and contain the bladder therein without issue.

LIST OF ELEMENTS

10 bottle
12 bottle top cap (either dummy, or functional when used alternatively)
14 bottle base
16 bottle base cap
18 bottle base cap pin or hinge
20 bottle base opening
22 lip at bottle base opening
24 threaded extension on inside surface proximate bottle base
30 bladder
32 bladder top
32' bladder top cap
34 bladder base
36 bladder locknut
38 internal threads, bladder lock nut
40 spout
42 spout connecting end
44 external threads, spout connecting end
46 spout body with internal flow path in fluid communication with internal flow channel of bladder lock nut 36, when connected
48 spout fluid release button
50 spout port
52 disk-shaped gasket
52' disk-shaped gasket with threaded extension 54 to complement threaded extension 24
60 bottle
62 bottle base
64 bottle base cap
66 bottle base cap hinge or pin
67 outer threads on bottle top neck
68 bottle top cap
69 bottle top cap threads
70 first bottle part
72 second bottle part
73 first bottle part threads for connecting to second bottle part
74 second bottle part threads for connecting to first bottle part
80 bladder
80' bladder with covering (e.g., foil), covering opening 108 in bladder 80'
81 spout port
82 spout
82' spout with cutters (102*a*, 102*b*)
83 spout first connecting means or threads
84 spout gasket
85 spout second connecting means or threads
86 upper spout locknut
88 liquid release button
89 spout flange
90 fill opening in the bottom of the bladder
92 disk gasket
93 male threads of bladder port element
94 bladder end cap
95 bladder cap threads

97 bladder end
97A bladder port element
102*a* cutter
102*b* cutter
106 cover (e.g., foil) for opening bladder 80'
108 opening in bladder 80'
110 shoulder of cover 106
112 covering material of cover 106, such as plastic or a film or a foil, preferable liquid resistant As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. A plastic liquid container and dispensing system, comprising:

a plastic bottle with a bottle top, a bottle base and an internal bottle volume;

a bladder or insert for holding liquid that includes a bladder top, an opening at the bladder top, a bladder base, a bladder internal volume, and a lock-nut within the bladder internal volume for securing the bladder; and a spout having a spout body with a connecting end, an internal liquid flow path extending from the connecting end to a liquid outflow port enabling liquid flow through the internal liquid flow path and out the liquid outflow port and a release button;

wherein the spout connecting end is passed through the bladder opening and removably secured to the bladder lock-nut and dispenses the liquid held in the bladder when the release button is pressed; and wherein the bladder includes a cover that covers the opening at the bladder to sealingly maintain liquid therein and that is pierced to enable liquid flow from the spout.

2. The liquid container and dispensing system of claim 1, where the cover comprises thin, sheet material selected from a group of sheet materials consisting of plastic, and metallic foil.

3. The liquid container and dispensing system of claim 1, wherein the spout connecting end includes a cutter for cutting the cover and allowing for liquid communication through the opening.

4. The liquid container and dispensing system of claim 1, wherein the cover includes a shoulder just below the opening.

5. The liquid container and dispensing system container and dispensing system according to claim 1, wherein the plastic bottle is non-toxic and BRA-free.

6. The liquid container and dispensing system container and dispensing, system according to claim 1, wherein the bladder is non-toxic and BPA-free.

7. The plastic liquid container and dispensing system according to claim 1, further comprising a plastic gasket positioned on the connecting end of the spout outside the bladder before the connecting end of the spout is connected to the bladder lock-nut, during intended use.

8. The plastic liquid container and dispensing system according to claim 7, wherein the bottle further comprises internal threads for connecting and maintaining the plastic gasket and, therefore, the bladder and spout connected thereto, at a fixed position within the bottle internal volume.

9. The plastic liquid container and dispensing system according to claim 1, wherein an outer surface of the connecting end of the spout and an inner surface of the bladder lock-nut are provided with complementary, threads for effecting fixation therebetween.

10. A plastic liquid container and dispensing system, comprising:

a plastic bottle with a first bottle part that is detachably connected to a second bottle part to form in internal bottle volume, the first bottle part including a bottle top, and the second bottle part including a bottle base;

a bladder for holding liquid including a bladder top with an opening, a bladder base and a bladder lock-nut positioned at or fixedly attached to the bladder top and formed with a flow path for liquid out of the bladder; and a spout having a spout body with a connecting end for connection to the bladder, a plastic gasket positioned on the connecting end of the spout and an internal liquid flow path extending from the connecting end to a liquid outflow port for liquid flow through the internal liquid flow path and out the liquid outflow port;

wherein the spout connecting end is inserted through the opening and removably attached via first threads to the bladder lock-nut to connect the spout to the bladder; and wherein the bladder includes a cover that covers the opening at the bladder top to sealingly maintain liquid therein.

11. The plastic liquid container and dispensing system of claim 10, wherein the spout includes a release button for enabling the liquid flow through the internal liquid flow path and out the liquid outflow port.

12. The plastic liquid container and dispensing system of claim 10, wherein a spout flange is positioned between the spout and the bladder gasket to facilitate connecting the bladder and spout to the bottle top.

13. The plastic liquid container and dispensing system of claim 10, wherein detaching the first bottle part from the second bottle part enables access to the bottle internal volume, and wherein the bladder is inserted or removed from the bottle inner volume.

14. The plastic liquid container and dispensing system of claim 11, wherein actuating the release button opens a liquid flow for the liquid present in the bladder to flow through the spout at the top of the bottle.

15. The plastic liquid container and dispensing system of claim 14, wherein the spout connecting end is passed through the bladder opening and removably secured to the bladder lock-nut and dispenses the liquid held in the bladder when the release button is pressed.

16. The liquid container and dispensing system of claim 10, where the cover is made of a plastic or metallic foil sheet material.

17. The liquid container and dispensing system of claim of claim 16, wherein spout connecting end includes a cutter for cutting the cover and allowing for liquid communication through the opening.

18. The liquid container and dispensing system of claim of claim 17, wherein the cover includes a shoulder just below the opening.

19. A plastic liquid container and dispensing system, comprising:

a plastic bottle with a first bottle part that is detachably connected to a second bottle part to form in internal bottle volume, the first bottle part including a bottle top, and the second bottle part including a bottle base;

a bladder for holding a liquid, the bladder positioned in the internal volume and formed with a bladder top having an opening, a bladder base and a bladder lock-nut positioned at or fixedly attached to the bladder and formed with a flow path for liquid out of the bladder; and a spout having a spout body with a threaded outer surface including a connecting end for connection to the bladder, a spout flange positionable along the threaded outer surface, and an internal liquid flow path extending from the connecting end to a liquid outflow port for liquid flow through the internal liquid flow path and out the liquid outflow port;

wherein the spout connecting end is inserted through the opening in the bladder top up to a location of the spout flange on the threaded outer surface to connect the spout to the bladder, attached via the threaded outer surface to the bladder lock-nut, thereby connecting the spout to the bladder;

wherein the first bottle part is connected to the second bottle part, sealingly enclosing the bladder within the internal bottle volume; and wherein the bottle top of the first bottle part connects to the spout.

20. The plastic liquid container and dispensing system of claim 19, wherein the bladder includes a cover that covers the opening at the bladder to sealingly maintain liquid therein; and wherein a spout connecting end includes a cutter for cutting the cover and allowing for liquid communication through the opening.

* * * * *